United States Patent [19]

Guerrini et al.

[11] 4,178,107

[45] * Dec. 11, 1979

[54] TYPING DEVICE

[75] Inventors: Giampaolo Guerrini, Ivrea; Dario Bisone, Montalto Dora, both of Italy

[73] Assignee: Ing. C. Olivetti & C., S.p.A., Ivrea, Italy

[ * ] Notice: The portion of the term of this patent subsequent to Oct. 5, 1993, has been disclaimed.

[21] Appl. No.: 793,391

[22] Filed: May 3, 1977

Related U.S. Application Data

[60] Continuation of Ser. No. 709,126, Jul. 27, 1976, abandoned, which is a division of Ser. No. 475,122, May 31, 1974, Pat. No. 3,983,985.

[30] Foreign Application Priority Data

Jun. 19, 1973 [IT] Italy ..... 68815 A/73

[51] Int. Cl.[2] ..... B41J 1/30

[52] U.S. Cl. ..... 400/144.2; 400/174

[58] Field of Search ..... 197/6.7, 18, 52–54; 101/93.18, 93.19; 403/261, 263, 325, 327, 330; 400/144.2–144.4, 174

[56] References Cited

U.S. PATENT DOCUMENTS

| | | | |
|---|---|---|---|
| 2,127,509 | 8/1938 | Fuchs | 197/16 |
| 2,146,380 | 2/1939 | Reiber | 178/29 |
| 3,307,677 | 3/1967 | Frank et al. | 197/16 X |
| 3,651,916 | 3/1972 | Becchi | 197/54 |
| 3,707,214 | 12/1972 | Ponzano | 197/53 |
| 3,831,728 | 8/1974 | Woods et al. | 197/1 R |
| 3,983,985 | 10/1976 | Guerinni et al. | 400/144.2 |

FOREIGN PATENT DOCUMENTS

| | | | |
|---|---|---|---|
| 2159261 | 8/1972 | Fed. Rep. of Germany | 197/53 |

*Primary Examiner*—Paul T. Sewell

[57] ABSTRACT

A typing device comprises a character-bearing disc having a central part for being fixed on a selector shaft and a peripheral rim with a plurality of selectable flexible laminae. Each lamina carries a particular character and striking means flexes the selected lamina to strike against a typing point of a sheet carrying platen for typing. A positioning element, for angular positioning the characters with respect to the typing point, comprises a recess cooperating with a wedge-shaped profile of each one of the selected laminae when the character strikes on said platen. The laminae carry alphabetic and numerical characters and a gap on the peripheryof the disc enables the last typed characters of a typing line to be seen and read. Further a hooked element cooperates with an elastic means of a flange integral with the selector shaft to removably fix the character bearing disc to the selector shaft.

9 Claims, 8 Drawing Figures

TYPING DEVICE

This is a continuation, of application Ser. No. 709,126, filed July 27, 1976, now abandoned, which is a division of Ser. No. 475,122, filed May 31, 1974, now U.S. Pat. No. 3,983,985.

BACKGROUND OF THE INVENTION

The present invention relates to a typing device comprising a character-bearing disc of plastics material having a central part by which it is fixed to a selector shaft and a plurality of flexible laminae radiating from the central part, each carrying a particular character. A hammer is used to cause lamina of the selected character to strike against a sheet-bearing platen for typing. The invention particularly concerns positioning means used for angular positioning of the character relative to the typing point.

A typing arrangement of the above-mentioned kind is known, in which positioning of the character is obtained by rotation of the character-bearing disc by means of a step-wise drive and the striking is obtained by means of the hammer which selectively engages the laminae under the control of an electromagnet. With this solution typing is very fast, but the lamina is not guided, either during the approach of the hammer nor during the striking. In addition to this, angular positioning of the step-wise drive and of the character-bearing disc cannot be precise, both because of the tolerances of manufacture of the relative parts, particularly the drive rotor, and because of oscillation of the disc prior to its positioning. Therefore, both the alignment of the typing on the sheet and the neatness of the printed letters are to some extent open to improvement.

Typing arrangements are also known in which a disc of plastics material is continuously rotatable and the lamina beneath the character to be typed is caught on the fly by the hammer. The hammer has a circular rim and rectifies the position of the lamina by acting on a radial channel formed on the face of the lamina opposite that bearing the character. In this way the problem of alignment is partially solved, but to obtain sufficient robustness of the channelled laminae there is required a lamina width greater than is strictly required by the character. This involves discs of rather cumbersome diameter.

SUMMARY OF THE INVENTION

One object of the invention is, therefore, to provide a typing device with a character-bearing disc having flexible laminae that are not too cumbersome and in which the characters are typed with alignment and neatness equal to those of standard typewriters.

According to the present invention, there is provided a typing device comprising a character-bearing disc of plastics material having a plurality of laminae radiating from a central part, each lamina carrying a particular character, means for rotating a selected lamina to a typing point, a hammer operable to strike the selected lamina towards a platen to effect typing of the character, and a positioning element for rectifying the angular position of the selected lamina at the typing point, wherein each lamina has a portion with a wedge-shaped profile and the positioning element has a complementary recess into which the wedge-shaped profile of the selected lamina is arranged to enter.

In order to avoid breakage of the character-bearing disc on account of excessive oscillation of the laminae, it is preferred that the lamina are substantially uniform in width and thickness decreasing radially outwardly, so as to obtain, over the entire length of the lamina, substantially uniform bending stresses when the laminae are struck by the hammer for typing.

A typical problem for character-bearing discs is that of permitting visibility of the latest character imprinted on the sheet of paper. According to a known arrangement, the characters of the disc are each carried on an element inclined relative to the radial lamina. With this solution there is the inconvenience that, during typing, the lamina is not only bent but also twisted. This increases the tendency towards breakage of the laminae. In addition, this movement does not permit clean striking in the plane of the characters on the page, and leads to the typed characters being smudged.

In another known arrangement, the disc is provided at its perimeter with a gap to allow visibility. An inconvenience of this solution is that to contain all the characters and symbols required, the disc must have a diameter greater than is strictly necessary, resulting in this case also in greater clumsiness and inertia.

In order to overcome this problem, the gap can be formed by a plurality of contiguous laminae which bear characters of lesser height than other characters and which are of less length than the other laminae.

As described below, improved means may be provided for releasably attaching the disc to a flange of a selector shaft, whereby removal and fitting of the disc are rendered very simple and quick without sacrificing security of fixing or reliability of alignment of the disc.

BRIEF DESCRIPTION OF THE DRAWINGS

The invention will be described in more detail, by way of example, with reference to the accompanying drawing, in which.

DESCRIPTION OF THE PREFERRED EMBODIMENT

Figure 1:
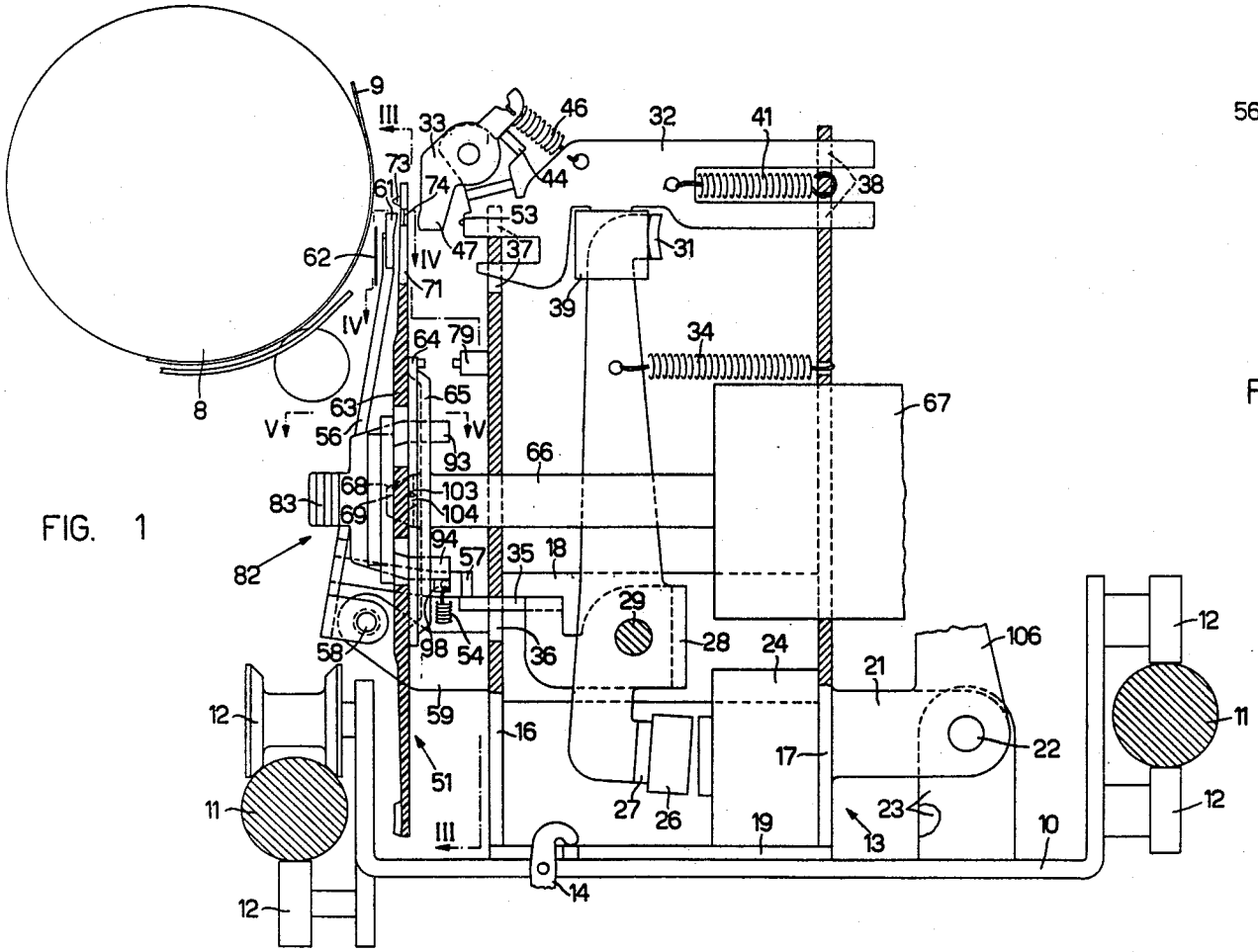
FIG. 1 is a partial section of a typing device embodying the invention.

With reference to FIG. 1, the typing device comprises a normal paper-carrying platen 8 on which lies the typing sheet 9, and a carriage 10 transversely movable across the typing sheet 9 along guides 11. The carriage 10 runs on the guides 11 by means of rollers 12 mounted on ball bearings and capable of sliding in both directions, for example, under the action of a reversible electric motor, not shown in the drawings, as described in U.S. Pat. No. 3,707,214, of Ponzano, assigned to the same assignee as this application, and incorporated herein by reference.

A frame 13 stands on the carriage 10 and is held down by a hook 14. The frame 13 is composed of vertical plates 16 and 17 connected by two cross-pieces 18 (FIG. 2) and by a base plate 19 (FIG. 1). The frame is hinged to the carriage 10 by means of lugs 21 integral with plate 17, lugs 23 standing up from the carriage 10, and pivot pins 22. The frame 13 can thus be swung up when the hook 14 is released.

An electromagnet 24 fixed to the vertical plate 17 and to the base plate 19 co-operates with an armature 26 integral with a lug 27 of a bail 28. The bail 28 can be rotated on a spindle 29 supported by the cross-piece 18 (FIG. 2), and by means of a lug 31, co-operates with a support 32 of a hammer 33 (FIG. 1). A spring 34 normally holds the bail 28 motionless with a lug 35 pressed against the top of a slot 36 in the vertical plate 16.

The support 32 is perpendicular to the platen 8 and is slidably guided in slots 37 and 38 provided in the vertical plates 16 and 17 respectively. The support 32 is normally positioned with a rubber element 39 pressed against the lug 31 of the bail 28 under the action of a tension spring 41 anchored to the vertical plate 17.

The hammer 33 is pivoted on the support 32 and is normally held at rest against a lug 44 of the support 32 by means of a biasing spring 46. One end 47 of the hammer 33 has an outer edge designed to co-operate with a character-bearing disc 51, and an inner edge designed to engage a shoulder 53 of the support 32.

Figure 2:
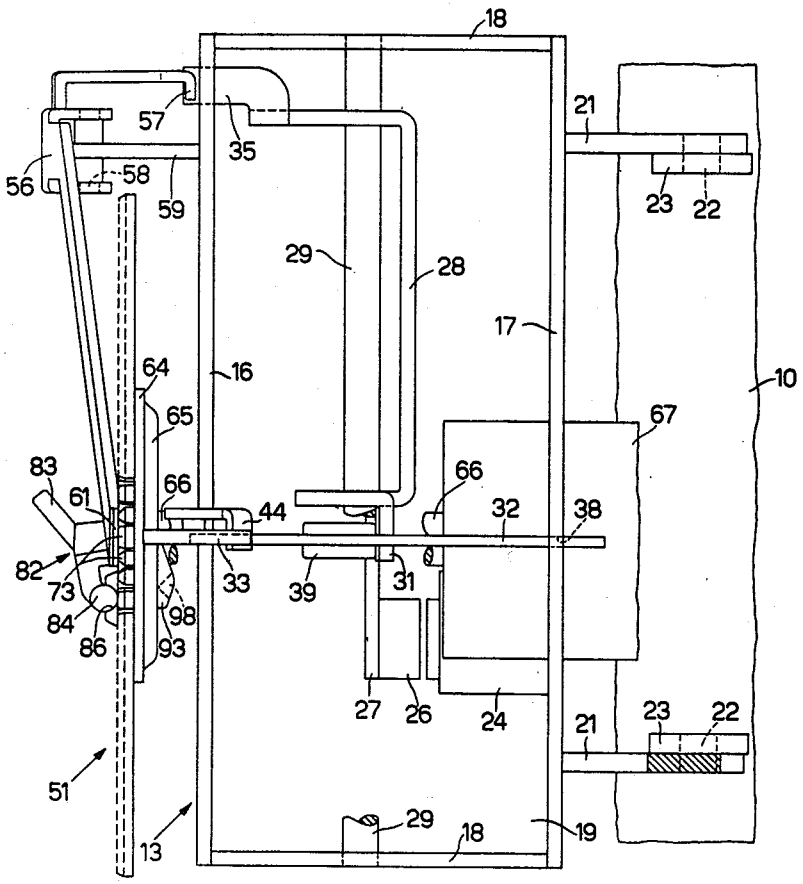
FIG. 2 is a partial plan view of FIG. 1.
Figure 3:
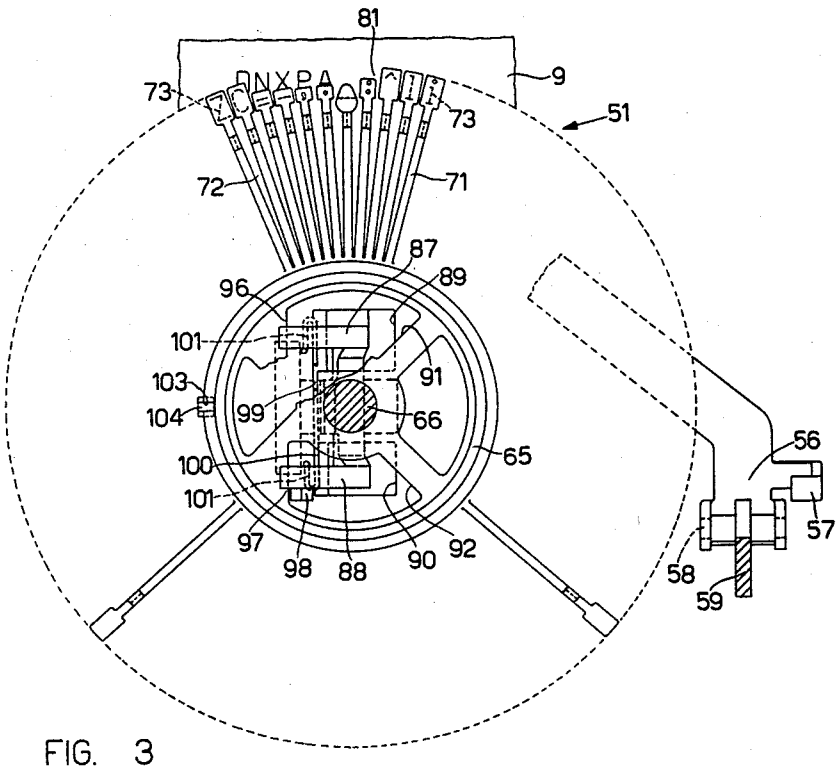
FIG. 3 is a partial section along the line III—III of FIG. 1.

A positioning block 61 (FIGS. 1 and 2) is mounted at the upper end of a positioning arm 56 having a bracket structure at its lower end pivoted by a pin 58 on a tongue 59 integral with the plate 16, (FIGS. 1, 2 and 3). A spring 54 urges the arm 56 clockwise in FIG. 1 so that a lug 57 bears against the lug 35 of the bail 28. The positioning block 61 is transversely centred at the typing point between the disc 51 and an inked ribbon 62.

Figure 4:
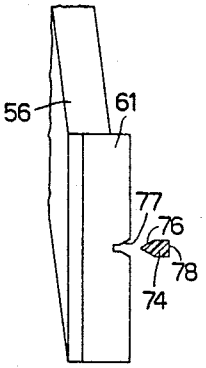
FIG. 4 is a partial section along the line IV—IV of FIG. 1 on a larger scale.

The character-disc 51 is constructed of flexible plastics material, for example, nylon reinforced with fibreglass, and has a substantially plane central part 63 attached to a peripheral rim 64 of a flange 65 of a selector shaft 66 for the disc, rotatable stepwise by an electric motor 67. The central part 63 has a conical seat 68 designed to be engaged by a conical end 69 of the selector shaft 66. The central part 63 is in one piece with a rim of reduced thickness and flexible laminae 71 of substantially uniform width radiating from the rim and separated by radial slits 72 (FIG. 3). Each lamina 71 has at one end a corresponding type character 73. The thickness of the laminae 71 decreases radially outwardly, so as to obtain, over the whole length of the laminae 71, substantially constant bending stresses when the laminae 71 are flexed by the hammer 33 for typing. Radially inside the character 73, each lamina 71 has a neck 74 (FIG. 4) with a wedge-shaped profile 76 on the character side and a flat profile 78 on the hammer side. The wedge 76 is designed to enter a complementary recess 77 in the positioning block 61.

Figure 8:
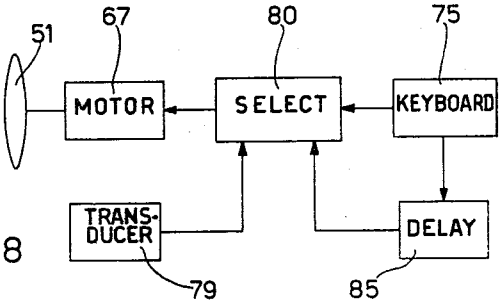
FIG. 8 is a diagram relating to the control of a detail of FIG. 1.

Selection of the type characters 73 is effected through the step-by-step motor 67 (FIG. 8) under the control of a keyboard 75 for operating a selection circuit 80 synchronised by a transducer 79 substantially as described in the aforementioned U.S. Pat. No. 3,707,214.

The type characters 73 (FIG. 3) are composed of upper and lower case alphabetical characters, numerical characters, punctuation marks, and arithmetical and other graphic signs commonly used in traditional office machines. In the character disc 51, the punctuation signs, for example: from left to right in FIG. 3: = (equals), — (hyphen), , (comma), . (full stop or period), __ (underline), are carried by contiguous laminae 71 as represented in FIG. 3. These laminae, corresponding to the above-cited signs, have their extremities set back relative to the extremities of the remaining laminae, thus leaving a gap 81 on the periphery of the disc 51.

The typewriter, teleprinter, calculator or other office machine incorporating the typing device in question, comprises a delay circuit 85 (FIG. 8) which automatically, after a fixed time during which there has been no actuation of the keyboard 75, rotates the motor 67 so as to bring the sign __ (underline) of the character-disc 51 over the typing point as shown in FIG. 3. In this way the gap 81 allows the latest characters imprinted on the typing sheet 9 to be visible and readable. The disc therefore begins each printing cycle from a rest variable position which is dependent upon the length of time between successive character selections. In addition, the arrowhead shape of the lamina which carries the underline sign serves as an index for indicating the typing point on the printing line.

Figure 5:
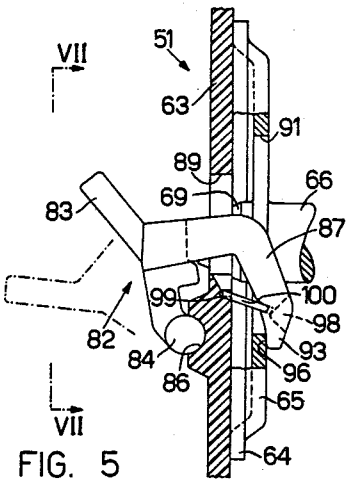
FIG. 5 is a partial section along the line V—V of FIG. 1 on a larger scale.

The character-bearing disc 51 is normally fixed to the rim 64 (FIG. 1) of the selector shaft 66 by means of a hooked element 82 (FIG. 5). The element 82 is composed of a handle 83, a cylindrical bar 84 designed to lodge in a cylindrical seat 86 of the character-disc 51, and of two L-shaped arms 87 and 88 (FIG. 3) spaced from each other and designated to pass through respective apertures 89 and 90 in the disc 51 and corresponding apertures 91 and 92 of the flange 65 located on diametrically opposite parts relative to the selector shaft 66. Each of the arms 87, 88, has a wedge-shaped end 93 (FIG. 5) or 94 respectively, whose under part co-operates with an edge 96 (FIG. 3) or 97 respectively of the apertures 91 and 92. Integral with the arm 88 is a tooth 98 designed to co-operate with the lower edge of the aperture 90 to prevent disengagement of the element 82 (FIG. 5) as will be described later.

Figure 7:
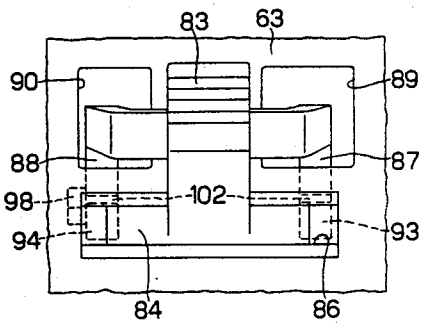
FIG. 7 is a partial view along the line VII—VII of FIG. 5.

A channel 99 cut in the disc 51 connects the two apertures 89 and 90 (FIG. 3) and is the seat for a spring 100. The spring 100 is of the compression type and is substantially C-shaped, its central portion being guided in the channel 99. The two ends 101 of the spring 100 engage in two channels 102 (FIG. 7) of the arms 87 and 88. Moreover, the ends 101 (FIG. 3) are bent outwards through 90° to engage the inner parts of the arms 87 and 88, thus preventing longitudinal displacement of the spring 100 when it is connected between the disc 51 and the element 82 (FIG. 5).

The flange 65 (FIG. 3) has a trapezoidal seat 103 designed to take a tooth 104 (also trapezoidal) which is integral with the disc 51. This matching has been arranged in order to ensure that the disc 51 can only be fixed to the flange 65 in one angular orientation.

Figure 6:
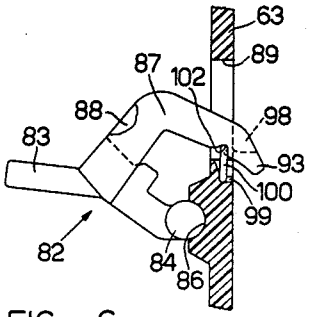
FIG. 6 is a partial view of some details of FIG. 5 in another working position.

In order to fix the hooked element 82 (FIG. 3) on the character-bearing disc 51, the following mode of action is employed. The handle 83 (FIG. 6) is grasped with one hand and the bar 84 is engaged in the corresponding seat 86. The element 82 is then turned clockwise so as to make the arms 87 and 88 enter the apertures 89 and 90, care being taken to keep the element 82 off-center with respect to the center of the disc 51 so that the tooth 98 (FIG. 7) passes through the aperture 90 without interfering with the lower edge of the aperture 90. The element 82 is then centered with respect to the center of the disc 51, sliding the bar 84 into the seat 86 until the tooth 98 rests below the edge of the aperture 90 as shown in FIG. 3. The compression spring 100 is now inserted, engaging the channel 99 with the mid-part of the spring 100, and with the ends 101, the channels 102 of the arms 87 and 88. The ends 101, bent outwards at 90°, press against the inner parts of the arms 87 and 88 and prevent the spring 100 from running into the channel 99. The spring 100 now exerts pressure on the arms 87 and 88 (FIG. 6) and makes the element 82 turn anticlockwise until it stops with the tooth 98 against the lower edge of the aperture 90 as shown in FIG. 6.

The procedure for fitting the disc 51 on the selector shaft 66 is as follows. The hook 14 (FIG. 1) is released in a known manner, by means not shown in the drawings, and a lever 106 is engaged with one hand, swinging the frame 13 up on the pins 22 so as to bring the shaft 66 into a substantially vertical position, i.e. turned through 90° from the normal position. The disc 51 (complete with element 82 and spring 100) is taken and placed with the seat 68 on the conical end 69 of the shaft 66, with the central part 63 against the peripherial rim 64 of the flange 65 and with the trapezoidal tooth 104 in the seat 103 of the rim 64.

The handle 83 is grasped, making the element 82 rotate clockwise so that the arms 87 and 88 (FIG. 3) snap through apertures 91 and 92 against the action of the spring 100. The spring 100 initially opposes such rotation as far as the dead point, and favors rotation after that. The arms 87 and 88 engage their wedge-shaped ends 93 and 94 (FIG. 7) or the edges 96 and 97 respectively so that the disc 51 is firmly fixed on the selector shaft 66. The fixing pressure exerted by the wedge-shaped ends 93 (FIG. 1) and 94 makes the conical seat 68 adhere to the end 69 of the shaft 66 and the rim of the central part 63 adhere to the corresponding peripheral rim 64 of the flange 65. The fixing pressure is exerted on an intermediate zone, between the conical coupling and the zone of contact of the rims, which takes up any possible play. The spring 100 (FIG. 3) exerts continuous pressure between the disc 51 and the arms 87 and 88 of the element 82, keeping it always in the fixing position.

The frame 13 (FIG. 1) is now swung down again and latched by means of the hook 14. To remove the disc 51, the operations described above are carried out in reverse order.

The operation of the typing machine according to the invention is similar to that described in the aforementioned U.S. Pat. No. 3,707,214. The difference lies essentially in the positioning block 61 and the hammer 33.

After selection of the character that is to be typed, a known device, not shown in the drawings, controlled by the selection circuit 80 (FIG. 8) raises the inked ribbon 62 (FIG. 1) to bring it into alignment with the typing line. The electromagnet 24 rotates the bail 28 counterclockwise against the action of the spring 34. The spring 54 then rotates the position arm 56 carrying the positioning block 61 in the clockwise direction, making the block 61 engage the neck 74 of the selected lamina. The wedge 76 (FIG. 4) starts to enter the recess 77.

The lug 31 of the bail 28 makes the support 32 slide in the slots 37 and 38 towards the paper carring platen 8 against the action of the spring 41. The hammer 33 engages with its outer edge the flat profile 78 (FIG. 4) of the neck 74. If the wedge 76 is not perfectly lodged in the recess 77, in a first phase the hammer 33 pushes the lamina into the recess 77 and rotates in the counterclockwise direction against the action of the spring 46 (FIG. 1) until it stops against the shoulder 53. The spring 46, however, exerts a retarding action on the lodgement of the neck 74 in the positioning block 61 and prevents rebound. Now the hammer 33, reacting to the shoulder 53 of the support 32, bends the lamina 71 until it types the selected character 73 on the typing sheet 9 on the platen 8. At the same time the hammer 33 causes the positioning arm 56 to rotate counterclockwise against the action of the spring 54 and thus allows the positioning block 61 to guide the lamina 71 during the approach and during the stroke.

When excitation of the electromagnet 24 stops, the spring 34 rotates the bail 28 until the lug 35 stops against the top of the slot 36. The spring 41 returns the support 32 to rest against the lug 31, while the spring 46 turns the hammer 33 and arrests it against the lug 44. At the same time the spring 54 brings the positioning arm 56 back into its rest position, with the lug 57 against the lug 35, and the inked ribbon 62 also returns to its initial position. The whole device is now again at rest and ready for a new cycle.

It is evident that each lamina 71 carries a single type character 73 and is provided with a wedge-shaped cam profile 76 on the same face that carries the character, and that the cam profile 76 is intended to co-operate in a complementary recess 77 of the positioning block 61 for angular positioning of the selected lamina 71.

We claim:

1. A typing device comprising:

a sheet-carrying platen defining a printing line and a typing point;

a character-bearing disk comprising a plurality of laminae each carrying a type character and terminating in a free end on the periphery of said disk;

means defining a gap in the outermost periphery of said disk;

input means for serially entering characters to be printed;

type character selecting means responsive to a character entered by said input means for rotating said disk and arresting the same so as to align a selected one of said laminae in front of said typing point, such rotation of said disk beginning from a rest variable position defined by the position reached by said disk upon printing the next preceding selected character;

striking means for impacting the selected lamina to type the selected character, said selecting means maintaining said selected lamina in front of said striking means after the impacting thereof; and means responsive to the absence of entered characters in said input means within a predetermined period of time after the entering of the last preceding entered character for rotating said disk from its last position wherein the last selected lamina is in front of said striking means to a position wherein said gap is aligned with said typing point, whereby the last typed characters can be seen through said gap.

2. A typing device according to claim 1, wherein said input means comprises an actuatable keyboard and wherein said means responsive to the absence of entered characters comprise a delay circuit operative on said selecting means after said keyboard has not been actuated for at least said predetermined period period of time for aligning a predetermined portion of said gap with said typing point.

3. A typing device comprising:

a sheet-carrying platen defining a printing line and a typing point;

a character-bearing disk comprising a plurality of laminae each carrying a type character and terminating in a free end on the periphery of said disk;

means defining a gap in the outermost periphery of said disk;

input means for serially entering characters to be printed;

type character selecting means responsive to a character entered by said input means for rotating said disk and arresting the same so as to align a selected one of said laminae in front of said typing point, such rotation of said disk beginning from a rest variable position defined by the position reached by said disk upon printing the next preceding selected character;

striking means for impacting the selected lamina to type the selected character;

means responsive to the absence of entered characters in said input means within a predetermined period of time after the entering of the last preceding entered character for rotating said disk to align said gap with said typing point, whereby the last typed characters can be seen through said gap; and index means adjacent said gap for indicating the typing point in said printing line.

4. A typing device according to claim 3 wherein said index means comprise a lamina which is shorter than the other laminae and carries a (underline) sign.

5. A typing device comprising a selector shaft, a character-bearing disk constructed of flexible plastics material and means for removably fixing said disk to said selector shaft, said selector shaft having a shaft axis, a conical end and flange means, extending radially outwardly a predetermined radial distance from said shaft axis and defining a rotation plane perpendicular to said shaft axis, wherein the character-bearing disk includes a plurality of laminae, a central part and a conical seat, cooperative, respectively, with said flange means and said conical end for aligning said laminae in a plane parallel to said rotation plane, wherein said shaft and said disk each comprises attachment portions radially spaced from said shaft axis a distance less than said predetermined radial distance; and wherein said fixing means comprise a hooked element engageable with the attachment portions at said shaft and said disk for fixing the disk to the selector shaft by making said central part adhere to said flange means and said conical seat adhere to said conical end taking up any possible play therebetween, said hooked element being releasable from said attachment portions for the removing of said disk from said selector shaft.

6. A typing device according to claim 5, wherein said hooked element is supported by the central part of said disk for being manually operable between a first position and a second position; to cause the disk to be fixed to and, respectively, released from said selector shaft; further comprising;

a spring member connecting said central part with said hooked element for elastically holding the same stably in either of said first and second positions, passing through an unstable position of the hooked element intermediate said first and said second positions.

7. A typing device comprising a character-bearing disk having a central part and a plurality of flexible laminae, each lamina carrying a particular character; a selector shaft having a shaft axis and including a flange fixed to said shaft; and means for removably fixing the disk to the shaft, said fixing means comprising:

a hooked element supported by the central part of said disk and manually operable between a first position and a second position;

said hooked element in said first position cooperating with said flange for fixing said central part to said flange coaxially to said shaft axis, and said hooked element, in said second position, releasing said flange for enabling said disk to be manually removed from said selector shaft; and a spring member connecting said central part with said hooked element for holding the same stably in either of said first and second positions, passing through an unstable position of the hooked element intermediate said first and said second positions; wherein said flange and said disk are provided with corresponding registering apertures located diametrically opposite with respect to said shaft axis, wherein said flange comprises support edges adjacent to the apertures of said flanges and said hooked element is fulcrumed on said disk and comprises two L-shaped arms for passing through said apertures, and wherein each of said arms has a wedge-shaped end arranged to exert pressure on the support edges of said flange, in the first position of said hooked element.

8. A typing device according to claim 7, wherein said hooked element comprises a cylindrical part designed to turn movably on a corresponding concave seat of said disc.

9. A typing device according to claim 7, wherein said spring member comprises a C-shaped spring of the compression type, and C-shaped spring having a central part guided by a seat in said central part of said disc and two terminals guided by corresponding seats of said L-shaped arms.

* * * * *